US007169098B1

(12) United States Patent
McGanty

(10) Patent No.: US 7,169,098 B1
(45) Date of Patent: Jan. 30, 2007

(54) ADJUSTABLE STRETCHING MACHINE

(76) Inventor: Stephen H. McGanty, 653 Thirtieth St., Hermosa Beach, CA (US) 90254

( * ) Notice: Subject to any disclaimer, the term of this patent is extended or adjusted under 35 U.S.C. 154(b) by 0 days.

(21) Appl. No.: 09/453,803

(22) Filed: Feb. 28, 2000

(51) Int. Cl.
*A63B 22/16* (2006.01)

(52) U.S. Cl. ..... 482/146; 482/147; 482/34; 482/79; 482/80

(58) Field of Classification Search ..... 482/142, 482/907, 908, 146, 147, 79–80, 71–72, 135–138, 482/145–148, 34, 140, 121, 122–126, 14, 482/19; D21/665, 668, 671, 685, 686, 688, D21/689
See application file for complete search history.

(56) References Cited

U.S. PATENT DOCUMENTS

| | | | | | |
|---|---|---|---|---|---|
| 828,221 | A | * | 8/1906 | Langel | 602/24 |
| 956,681 | A | * | 5/1910 | Clark | 108/4 |
| 1,283,210 | A | * | 10/1918 | Kinney | 482/79 |
| 1,671,096 | A | * | 5/1928 | Anderson | 482/79 |
| 3,297,320 | A | * | 1/1967 | Benedetto | 482/79 |
| 3,381,928 | A | * | 5/1968 | White | 248/455 |
| 3,401,931 | A | * | 9/1968 | McCafferty et al. | 482/19 |
| 3,416,792 | A | * | 12/1968 | Morgan et al. | 482/79 |
| 3,653,715 | A | * | 4/1972 | Drabert et al. | 297/439 |
| 4,084,810 | A | * | 4/1978 | Forsman | 273/73 |
| 4,253,661 | A | * | 3/1981 | Russell | 482/79 |
| 4,270,749 | A | * | 6/1981 | Hebern | 272/96 |
| 4,279,415 | A | * | 7/1981 | Katz | 482/80 |
| 4,306,714 | A | * | 12/1981 | Loomis et al. | 272/96 |
| 4,429,868 | A | * | 2/1984 | LeBlanc et al. | 272/93 |
| 4,531,730 | A | * | 7/1985 | Chenera | 482/142 |
| D281,343 | S | * | 11/1985 | Krive | D21/670 |
| 4,561,649 | A | * | 12/1985 | Forsythe | 272/96 |
| 4,629,180 | A | * | 12/1986 | Kaya | 272/93 |
| 4,629,181 | A | * | 12/1986 | Krive | 272/97 |
| 4,693,470 | A | * | 9/1987 | Ogawa | 272/96 |
| D298,266 | S | * | 10/1988 | Reyneke | D21/286 |
| 5,050,861 | A | * | 9/1991 | Thomas et al. | 482/52 |

(Continued)

*Primary Examiner*—Lori Amerson
(74) *Attorney, Agent, or Firm*—Steptoe & Johnson LLP

(57) ABSTRACT

An adjustable stretching device 6 includes a stretching surface 20 that is raised off of the floor on which the user stands, flexes, and stretches the calf and lowers the leg muscles. The stretching surface 20 can be angled along a primary longitudinal angle 26 to produce a more intense stretch. Specifically, the stretching surface 20 can be angled up to 90 degrees. Additionally, the user can put a leg up on the center pad 50 and stretch the hamstring muscles. The adjustable stretching device 6 also includes a padded framework that allows a user to put a leg up on any of the bars at different heights and further stretch the leg muscles. The padding also provides protection for the bar. The stretching surface 20 of the adjustable stretching device 6 is preferably a dual stretching surface 20 that is angled either away from or towards the longitudinal centerline of the dual stretching surface 20 along the primary longitudinal angle 26. This angle can range between 0 and 45 degrees. The angle or wedge can be either integral to the platform or removable and clipped into place at different angles or slowly molded into desired angles. The adjustable stretching device 6 has a handrail assembly 40, which is foldable in nature for storage. The handrail assembly 40 also provides leverage for a more intense stretch. The adjustable stretching device 6 also includes magnets to provide better circulation for the feet or another desired area.

19 Claims, 2 Drawing Sheets

U.S. PATENT DOCUMENTS 5,087,036 A * 2/1992 Cooper ..... 272/96
5,273,020 A * 12/1993 Hayami ..... 128/33
D347,869 S * 6/1994 Friend ..... D21/191
5,354,247 A * 10/1994 Wilkinson ..... 482/52
5,356,203 A * 10/1994 Levasseur et al. ..... 482/79
5,366,430 A * 11/1994 Yao ..... 482/147
5,391,134 A * 2/1995 Heatwole ..... 482/146
5,407,408 A * 4/1995 Wilkinson ..... 482/54
5,470,292 A * 11/1995 Simon ..... 482/52
5,474,509 A * 12/1995 Hodgdon ..... 482/52
5,518,476 A * 5/1996 McLeon ..... 382/79
5,558,606 A * 9/1996 Poncini et al. ..... 482/79
5,620,404 A * 4/1997 Eyman ..... 482/142
5,645,511 A * 7/1997 Le Roux et al. ..... 482/52
5,651,753 A * 7/1997 Wilkinson ..... 482/52
5,656,000 A * 8/1997 Russell ..... 482/52
5,713,820 A * 2/1998 Carbone ..... 482/79
5,810,702 A * 9/1998 Wilkinson ..... 482/142
5,855,536 A * 1/1999 Wilkinson ..... 482/52
5,879,272 A * 3/1999 Mekjian ..... 482/51
5,879,275 A * 3/1999 Aruin ..... 482/147
5,891,002 A * 4/1999 Maki ..... 482/79
5,897,464 A * 4/1999 McLeod ..... 482/79
5,980,433 A * 11/1999 Ramsay ..... 482/80
6,042,523 A * 3/2000 Graham ..... 482/121
6,217,488 B1 * 4/2001 Bernardson ..... 482/79
6,244,992 B1 * 6/2001 James ..... D21/191
6,402,664 B1 * 6/2002 Marston ..... 482/52
6,589,141 B1 * 7/2003 Flaggs ..... 482/79
6,929,585 B1 * 8/2005 Arends ..... 482/19

* cited by examiner

ADJUSTABLE STRETCHING MACHINE

FIELD OF THE INVENTION

This invention relates generally to a stretching device, and more particularly to a device and method for stretching leg muscles and tendons, such as the calf muscles and Achilles tendon, in a more ergonomically correct and effective manner.

BACKGROUND OF THE INVENTION

Recently, people have begun to understand the importance of stretching. Many athletes, in particular, understand the importance this issue, particularly those whose coaches did not stress the significance of stretching when these athletes were growing up. Many such athletes have undergone physical therapy and rehabilitation in order to feel normal again, because their bodies have been damaged through a lack of stretching and an over emphasis on the muscle building during their youth.

Stretching enhances athletic ability, helps circulate blood flow to provide more energy, and allows greater ease of movement. Improper stretching can result in many negative consequences, such as reduced mobility when one gets older. In response to this knowledge, a few stretching machines have been made to capitalize in this market.

Some of these machines might have made stretching easier, but were not properly or ergonomically designed. The engineers for many of these machines did not do adequate research into the biomechanics of stretching. There is a continuing need in the art for a device that makes stretching easier, more convenient, and more time efficient. There is also a continuing need in the art for a device that is ergonomically designed for proper stretching, especially with respect to the calf muscles and the Achilles tendon. Furthermore, there is a continuing need for a device that caters to individuals stretching needs. More importantly, a desired stretching device should not be hurting the user in the long run.

DETAILED DESCRIPTION OF THE PREFERRED EMBODIMENTS

Figure 1:
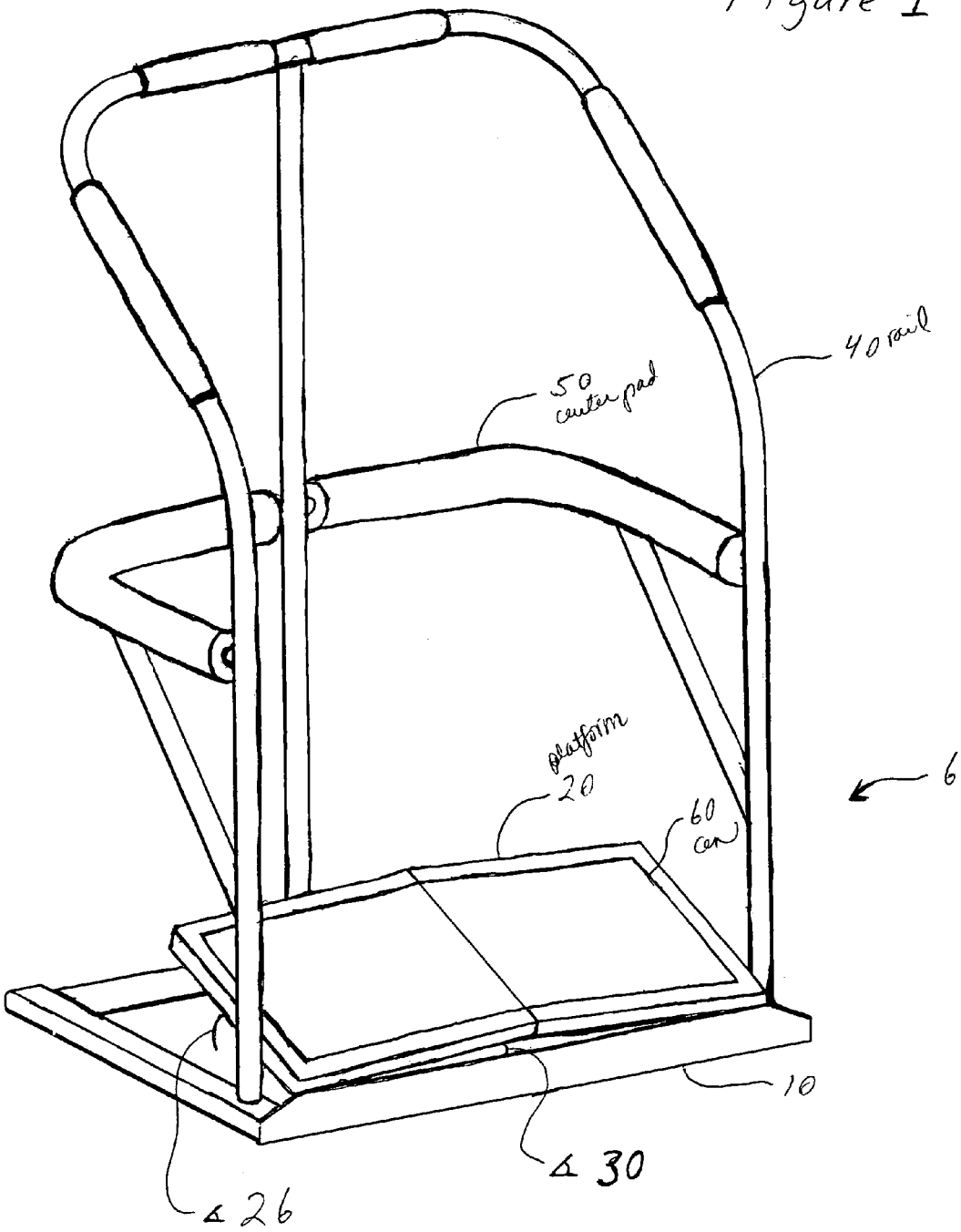
FIG. 1 shows a perspective view of a preferred embodiment of the adjustable stretching device of the present invention.
Figure 2:
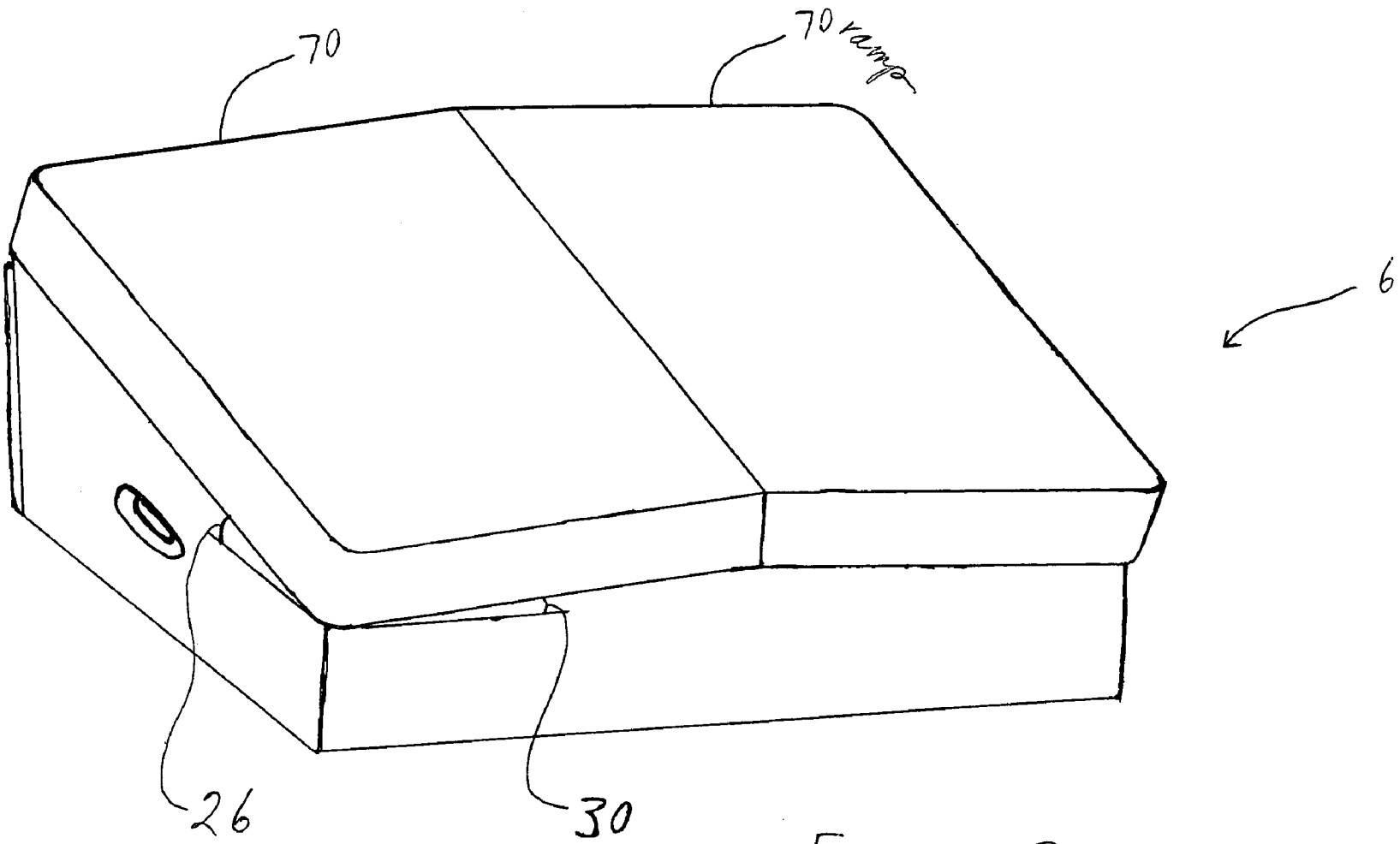
FIG. 2 shows a perspective view of another preferred embodiment of the adjustable stretching device of the present invention.

A preferred embodiment of the adjustable stretching device 6, according to the present invention, is shown in FIGS. 1 and 2. A preferred embodiment adjustable stretching device 6 has a base 10. In one embodiment, the base 10 is bolted to the floor while the adjustable stretching device 6 is in use. An adjustable stretching device 6 also preferably includes a platform 20 that mounts on the base 10. In one embodiment, the platform 20 angles up from the floor along a longitudinal centerline to form the primary longitudinal angle 26 of the adjustable stretching device 6. In a preferred embodiment adjustable stretching device 6 of the present invention, this primary longitudinal angle 26 is adjustable.

The top of the platform 20 also has secondary transverse angles 30, sloping off to the sides of the adjustable stretching device 6, as shown. Preferably, the secondary angels 30 range from 0–10 degrees, while more preferably the secondary angles range from 1–4 degrees.

In one embodiment of the present invention, the adjustable stretching device 6 further includes a rail assembly 40, which the user holds onto while stretching. Additionally, in one embodiment of the present invention, the adjustable stretching device 6 further includes a center pad 50, upon which the user positions a leg for a hamstring stretch. A preferred embodiment adjustable stretching device 6 of the present invention allows a user to simultaneously stretch the Achilles tendon and calf muscles of one leg while lifting the leg and stretching the hamstring on the other. In another aspect of the present invention, the platform 20 preferably has a wide section of anti-slip tape 60 to help prevent the user from slipping. This is especially needed at higher primary longitudinal angles 26.

In a preferred embodiment of the present invention that is shown in FIG. 2, the adjustable stretching device 6 further includes ramped stretching surfaces 70 that are shown at a 25-degree primary angle and a 4-degree secondary angle. Further, in this embodiment of the adjustable stretching device 6, the ramped stretching surfaces 70 open to reveal an interior storage compartment.

The adjustable stretching device 6 of the present invention provides significant advantages over other stretching machines due to the combination of providing an adjustable 1 to 10 degree secondary transverse angle 30, and an adjustable 0 to 90 degree primary longitudinal angle 26. This combination of angles provides a better stretch for the Achilles tendon and calf muscles. When the adjustable stretching device 6 is utilized, a user's foot is angled away from the longitudinal centerline the stretch is easier to perform. This angle makes stretching more effective without hurting other components of the foot.

Prior art stretching devices do not address the issue of the proper primary longitudinal stretching angles and proper secondary transverse angles, and as a result can actually do damage to people using these prior art stretching device due to improper stretching.

This angle or tilted platform 20 (or stretching surface) on the base 10 of the adjustable stretching device 6 allows for a more ergonomic and efficient stretch in the calf muscles and the Achilles tendon. The biomechanically designed stretching surface 20 enables a safe, more effective calf, Achilles, and ankle stretch. By tilting the stretching surface 20 about 4 degrees varus, the joints of the foot lock, and the foot become a rigid lever arm. Without this tilt, the foot is unlocked at the tarsal-metatarsal joint, causing a dorsal jamming (and breakdown) while attempting an Achilles stretch. Also, many prior art stretching machines do not have an adjustable base, which caters to the individual stretching needs of each user, as does the adjustable stretching device 6.

A preferred embodiment adjustable stretching device 6 of the present invention allows a user to stretch both the Achilles tendon and calf muscles at the same time, while allowing the stretching user to keep its back heel planted. This is important ergonomically because eccentric muscle contraction (stretching a muscle while contracted) is a primary cause of tendentious. For example, stretching your calves from a curb would cause eccentric muscle contraction. If a user is stretching the calves at an angle that is too steep, the user will not be able to maintain a planted heel during stretching. However, because the adjustable stretching device 6 has an adjustable stretching surface 20, the user can lower the primary longitudinal angle 26 to the level where the user can maintain a planted heel during stretching. What defines an angle that is too steep depends on the point and angle where the individual cannot plant his heel because of tight calves or any other reason. Any stretching machine that does not allow a user to plant its heels is not facilitating the proper method for stretching the calf muscles.

Also, this adjustable stretching surface 20 of the stretching device 6 allows a person more advanced in stretching to increase the angle of the stretch. Additionally, many prior art stretching machines do not provide handlebars on the machine to stabilize the user when stretching, or to provide leverage to achieve a more intense or less tense stretch.

In summary, a preferred embodiment adjustable stretching device 6 includes a stretching surface 20 that allows for angular adjustability along two axes; the first axis along the primary longitudinal stretching angle 26 and second axis along the secondary transverse angles 30. This combination of adjustability along both the longitudinal stretching angle 26 and the secondary transverse angles 30 makes for a more efficient stretch of the Achilles tendon and calf muscles. Moreover, the stretching machines in the marketplace do not offer pads to rest your legs while stretching the hamstrings from a standing position. This way, the user can simultaneously stretch the Achilles tendon and calf muscles of one leg while lifting the leg and stretching the hamstring on the other. These pads not only provide comfort, but they can reduce bruising and allow better circulation.

The invention claimed is:

1. An adjustable stretching device for static leg stretching, the device comprising:

a base platform; and dual stretching surfaces associated with the base platform that intersect along a longitudinal central line, wherein the dual stretching surfaces are angularly adjustable along the longitudinal central line, and are also angularly adjustable transverse to the longitudinal central line, and wherein the dual stretching surfaces and the base platform define non-moving surfaces against which to stretch, and wherein the dual stretching surfaces are free from reciprocal motion and enable non-reciprocal stretching from a standing position.

2. The adjustable stretching device of claim 1, wherein the dual stretching surfaces are angularly adjustable from a range of 0 to 45 degrees along the longitudinal central line.

3. The adjustable stretching device of claim 1, wherein angularly adjustability of the dual stretching surfaces along the longitudinal central line facilitates a user maintaining planted heels on the stretching surfaces, while also allowing adjustability of the stretch intensity provided by the stretching device.

4. The adjustable stretching device of claim 1, wherein the dual stretching surfaces are angularly adjustable from a range of 1 to 4 degrees transverse to the longitudinal central line.

5. The adjustable stretching device of claim 1, wherein the angularly adjustability of the dual stretching surfaces transverse to the longitudinal central line facilitates more effectively stretching of the leg muscles and tendons by locking the joints of the foot to prevent bone jamming.

6. The adjustable stretching device of claim 1, wherein the adjustable stretching device is ergonomically designed to facilitate stretching of the leg muscles and tendons.

7. The adjustable stretching device of claim 6, wherein the adjustable stretching device is ergonomically designed to facilitate stretching of the calf muscles and Achilles tendon.

8. The adjustable stretching device of claim 6, wherein the adjustable stretching device is ergonomically designed to facilitate stretching of the muscles in the front of the leg.

9. The adjustable stretching device of claim 1, wherein the dual stretching surfaces are operatively associated with one another.

10. The adjustable stretching device of claim 1, wherein the dual stretching surfaces are integral with the platform.

11. The adjustable stretching device of claim 1, wherein the dual stretching surfaces are removable from the platform.

12. The adjustable stretching device of claim 1, wherein the adjustable stretching device is portable, and further comprises hand holds to facilitate transportation of the adjustable stretching device.

13. The adjustable stretching device of claim 1, wherein the adjustable stretching device is at least partially hollow, thereby facilitating housing of selected items within the stretching device.

14. The adjustable stretching device of claim 1, wherein the adjustable stretching device further comprises hand rails operatively associated with the base platform of the stretching device.

15. The adjustable stretching device of claim 1, wherein the adjustable stretching device further comprises magnets for increasing circulation.

16. The adjustable stretching device of claim 1, wherein the dual stretching surfaces are clipped into angular position with respect to the base platform of the adjustable stretching device.

17. The adjustable stretching device of claim 1, wherein the dual stretching surfaces slowly molded.

18. An adjustable stretching device for static leg stretching, the device comprising:

a base platform; and at least one stretching surface associated with the base platform, wherein the at least one stretching surface is angularly adjustable along two axes that are substantially normal to each other, the angularly adjustable along two axes facilitating effective static leg stretching by compelling a stretching user's heel to remain planted on the stretching surface during stretching to lock the joints of the foot and thereby minimize or prevent bone jamming, and wherein the dual stretching surfaces define non-moving surfaces against which to stretch during a stretching period, and are individually and non-reciprocally adjustable during a non-stretching period, and wherein the dual stretching surfaces enable non-coordinated, non-reciprocal stretching from a standing position.

19. An adjustable, standing user-engaging, stretching device for static leg stretching, the device comprising:

a base platform; and dual, standing user-engaging, stretching surfaces associated with the base platform that intersect along a longitudinal central line, wherein the dual stretching surfaces are angularly adjustable along the longitudinal central line, and are also angularly adjustable transverse to the longitudinal central line, and wherein the dual, standing user-engaging, stretching surfaces define non-moving surfaces against which to stretch during a stretching period, and are individually and non-reciprocally adjustable during a non-stretching period, and wherein the dual stretching surfaces enable non-coordinated, non-reciprocal stretching of each leg of a user independently.

* * * * *

UNITED STATES PATENT AND TRADEMARK OFFICE

CERTIFICATE OF CORRECTION

PATENT NO. : 7,169,098 B1
APPLICATION NO. : 09/453803
DATED : January 30, 2007
INVENTOR(S) : Keith P. Donahue and Stephen H. McGanty It is certified that error appears in the above-identified patent and that said Letters Patent is hereby corrected as shown below:

On the Title page, (76) Inventor
Before "Stephen H. McGanty" add --Keith P. Donahue, 2216 Manhattan Ave., Manhattan Beach, CA (US) 90266--

In column 1
On line 15, after "importance" add --of--
On line 38, replace "individuals" with --individual--

In column 2
On line 1, replace "angels" with --angles--

In column 3
After line 27, add the following 3 paragraphs:

The adjustable stretching device 6 can be made of metal, wood, plastic, or other lightweight materials, to facilitate the portability of the device. In one preferred embodiment, the platform 20 can lift and open to create a storage box for storing other stretching and athletic equipment.

In another aspect of a preferred embodiment, the adjustable stretching device 6 further includes a handle 80 on each end to assist in carrying the device. Preferably, the handles 80 take the form of holes in the sidewalls of the adjustable stretching device 6. These holes in the sidewalls facilitate ventilation for the items in the box. In another preferred embodiment, the adjustable stretching device 6 also includes stops to space the device away from the wall.

A preferred embodiment adjustable stretching device 6 of the present invention facilitates ergonomically correct stretching of both the calf muscles and Achilles tendon. The adjustable stretching device 6 makes the stretches more efficient, hence, saving time in stretching and making the calf and Achilles stretch safer. The adjustable stretching device 6 of the present invention caters to an individual's stretching needs.

UNITED STATES PATENT AND TRADEMARK OFFICE

CERTIFICATE OF CORRECTION

PATENT NO. : 7,169,098 B1
APPLICATION NO. : 09/453803
DATED : January 30, 2007
INVENTOR(S) : Keith P. Donahue and Stephen H. McGanty It is certified that error appears in the above-identified patent and that said Letters Patent is hereby corrected as shown below:

In column 3
After line 27, add the following 3 paragraphs (cont'd):

While the description contains many specifics, it should not be construed as a limitation on the scope of the invention, but rather as an exemplification of one preferred embodiment thereof. Many variations are possible.

Signed and Sealed this

Eighth Day of May, 2007

JON W. DUDAS
*Director of the United States Patent and Trademark Office*